US008781140B2

(12) United States Patent
Lautenschlager et al.

(10) Patent No.: US 8,781,140 B2
(45) Date of Patent: Jul. 15, 2014

(54) COMPACT, HIGHLY INTEGRATED MICROPHONE ASSEMBLY

(75) Inventors: Eric J. Lautenschlager, Geneva, IL (US); Galen Kirkpatrick, Redondo Beach, CA (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 13/446,644

(22) Filed: Apr. 13, 2012

(65) Prior Publication Data

US 2013/0094674 A1 Apr. 18, 2013

Related U.S. Application Data

(60) Provisional application No. 61/475,913, filed on Apr. 15, 2011.

(51) Int. Cl.
*H04R 25/00* (2006.01)

(52) U.S. Cl.
USPC ..... 381/175; 381/369; 381/174

(58) Field of Classification Search
USPC ..... 381/173–175, 191, 356, 358, 361, 369; 367/170, 173, 174, 181, 188
See application file for complete search history.

(56) References Cited

U.S. PATENT DOCUMENTS 6,522,762 B1 2/2003 Mullenborn et al.
7,537,964 B2 * 5/2009 Minervini ..... 381/355

* cited by examiner

*Primary Examiner* — Suhan Ni
(74) *Attorney, Agent, or Firm* — Fitch, Even, Tabin & Flannnery LLP

(57) ABSTRACT

A microelectromechanical (MEMS) microphone assembly includes a MEMS structure, a base portion, and a lid. The MEMS structure includes a diaphragm that responds to changes in sound pressure and the MEMS structure contributes to a vertical dimension of the assembly. The MEMS structure is supported by the base portion. The lid partially but not completely encloses the MEMS structure, such that the portion of the MEMS structure is not surrounded by the lid, the lid, and the base portion form a boundary with and are exposed to the environment external to the microphone assembly.

20 Claims, 14 Drawing Sheets

COMPACT, HIGHLY INTEGRATED MICROPHONE ASSEMBLY

CROSS REFERENCE TO RELATED APPLICATION

This patent claims benefit under 35 U.S.C. §119 (e) to U.S. Provisional Application No. 61/475,913 entitled "Compact, Highly Integrated Microphone Architecture And Method Of Manufacture" filed Apr. 15, 2011 the content of which is incorporated herein by reference in its entirety.

TECHNICAL FIELD

This application relates acoustic assemblies and more specifically to the configuration of the components that form these assemblies.

BACKGROUND OF THE INVENTION

Various types of microphone systems have been used in various applications through the years. Microphones in these systems typically receive acoustic energy and convert this acoustic energy into an electrical voltage. This voltage can be further processed by other applications or for other purposes. For example, in a hearing aid system the microphone may receive acoustic energy, and convert the acoustic energy to an electrical voltage. The voltage may be amplified or otherwise processed by an amplifier, or by other signal processing electronics circuitry, and then presented by a receiver as acoustic energy to a user or wearer of the hearing aid. To take another specific example, microphone systems in cellular phones typically receive sound energy, convert this energy into a voltage, and then this voltage can be further processed for use by other applications. Microphones are used in other applications and in other devices as well.

In such systems, it is typically important that the microphone is small. For instance, over the years cellular phones have become increasingly smaller, requiring smaller and smaller components. To that end, Microelectricalmechanical Systems (MEMS) are often used in microphones, which are often placed entirely inside an outer housing. More specifically, previous configurations for MEMS microphones consist of a distinct die placed inside a separate external box or inside larger, molded encasings which serve as bulk walls. In other words, the entire die is contained within a surrounding assembly.

However, since these previous assemblies must hold the entire MEMS die and ASIC, their size typically remains relatively large. This has limited the size reductions that are possible with MEMS assemblies, which, in turn limits the size reductions possible in the device in which the assembly is disposed.

BRIEF DESCRIPTION OF THE DRAWINGS

For a more complete understanding of the disclosure, reference should be made to the following detailed description and accompanying drawings wherein.

Figure 2:
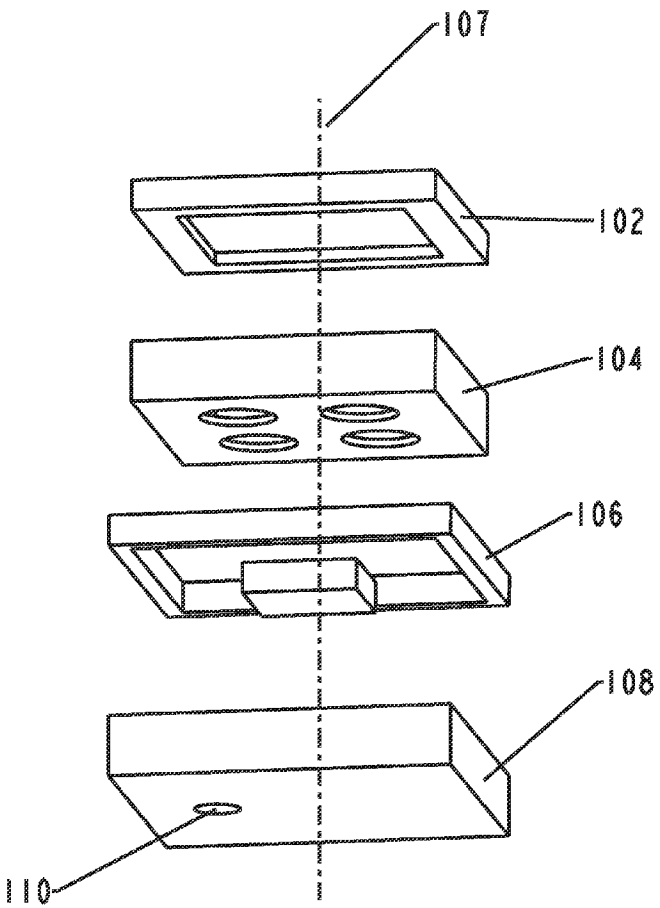
FIGS. 1 and 2 comprise perspective views of a MEMS microphone with a bottom port configuration and using a flip chip or ACF arrangement for both MEMS and ASIC according to various embodiments of the present invention.
Figure 1:
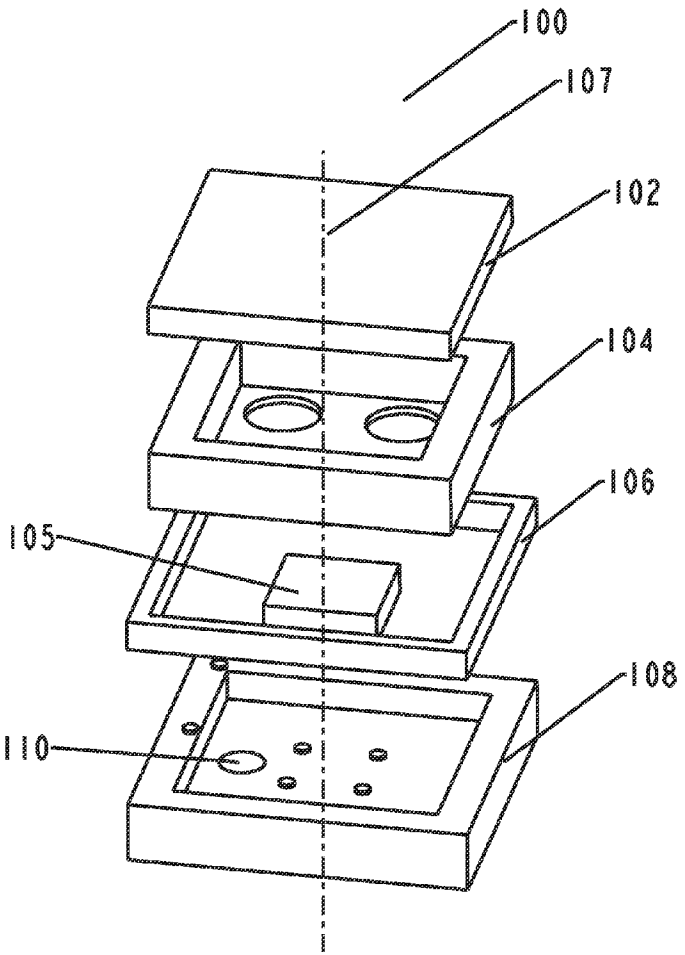
Figure 3:
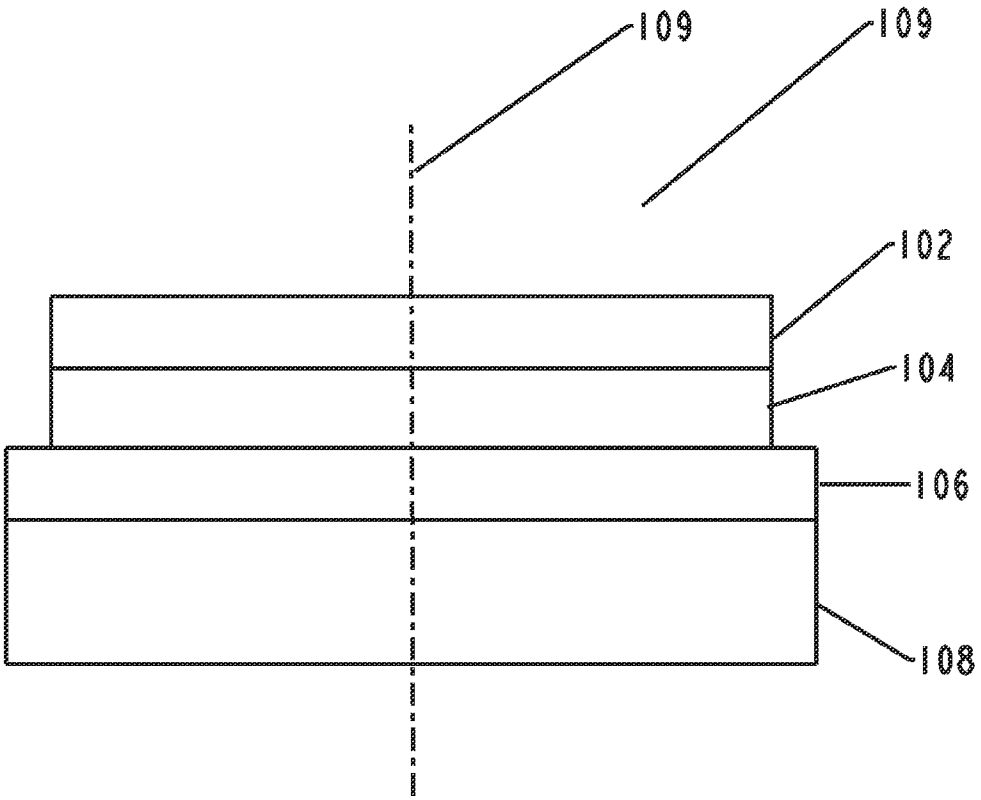
FIG. 3 comprises a side view of the MEMS microphone of FIGS. 1 and 2 according to various embodiments of the present invention.
Figure 4:
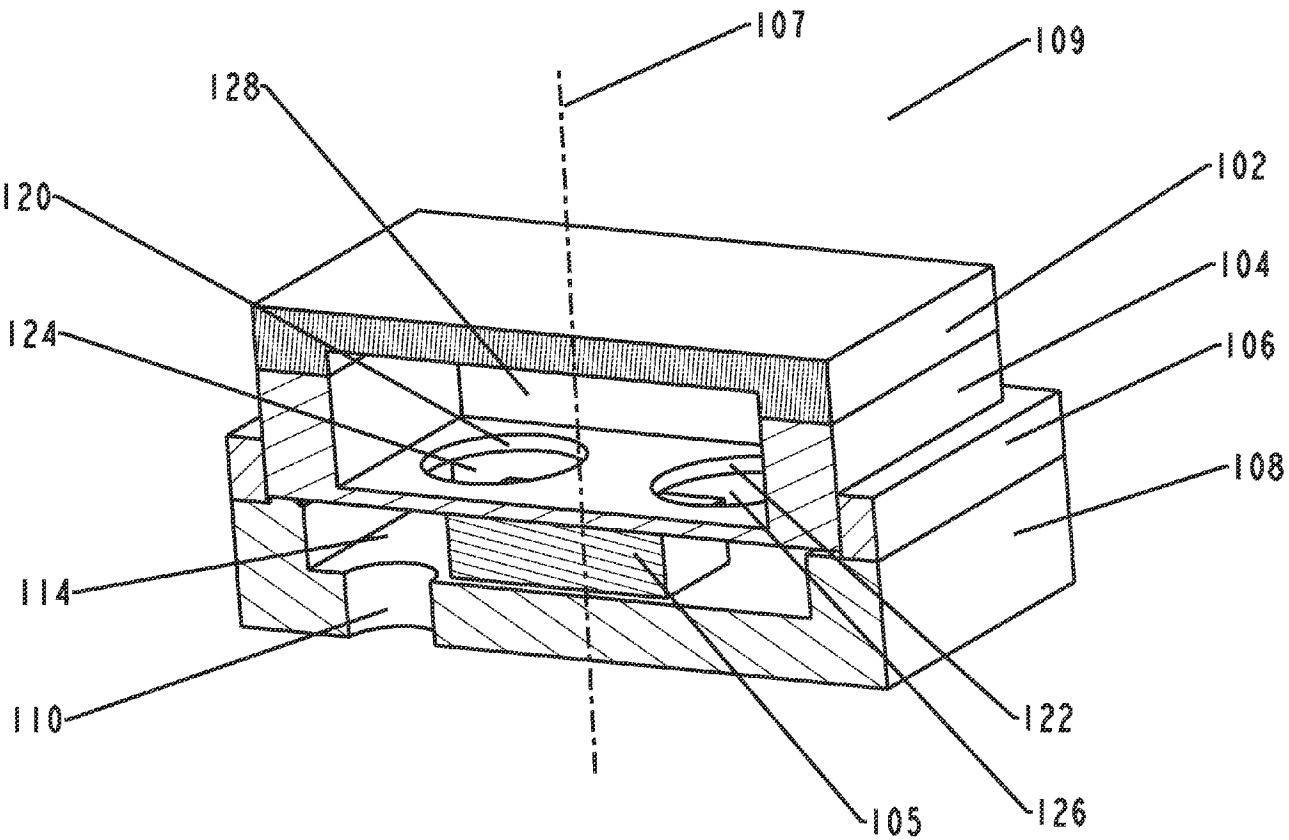
FIG. 4 comprises a mid-line cut-away perspective view of the MEMS microphone of FIGS. 1-3 according to various embodiments of the present invention.
Figure 5:
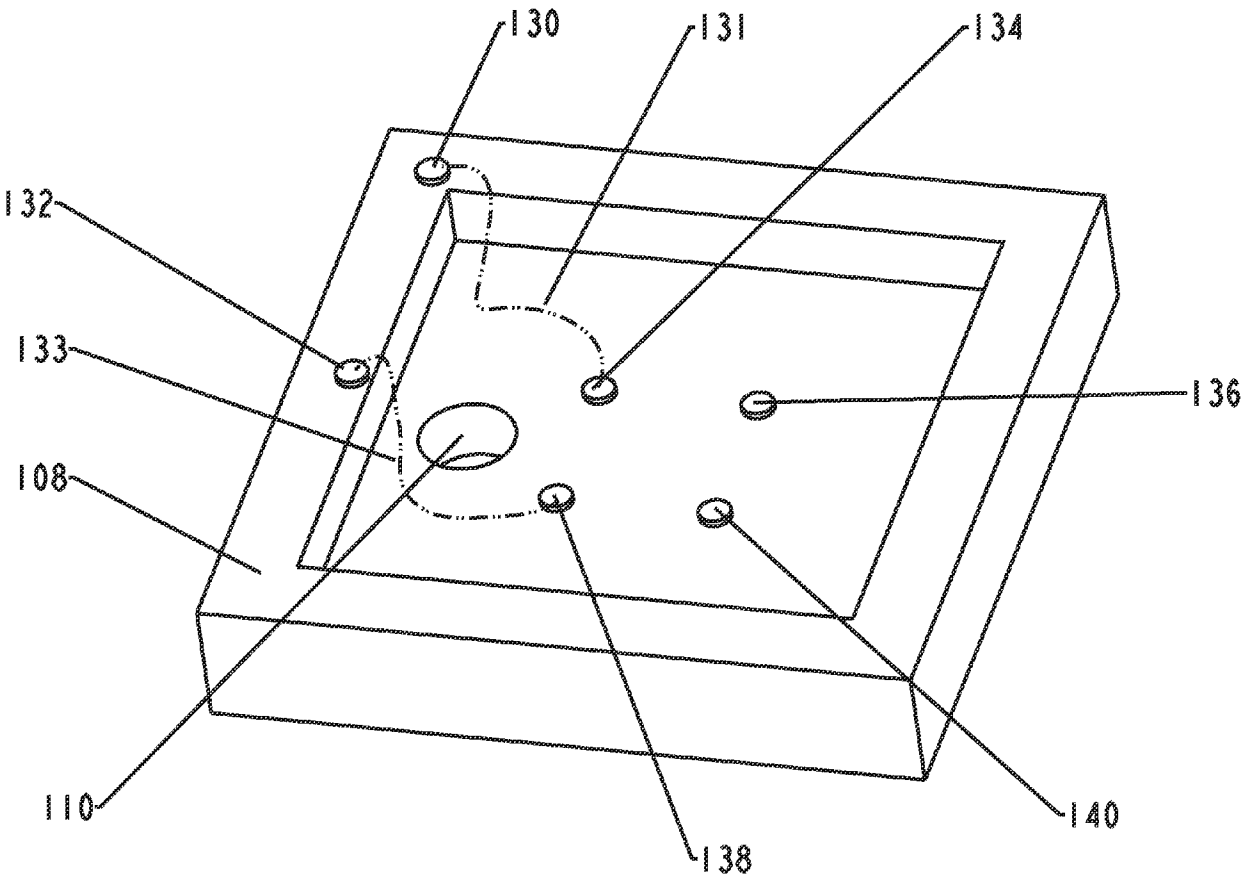
FIG. 5 comprises a perspective view of the base of the microphone of FIGS. 1-4 according to various embodiments of the present invention.
Figure 6:
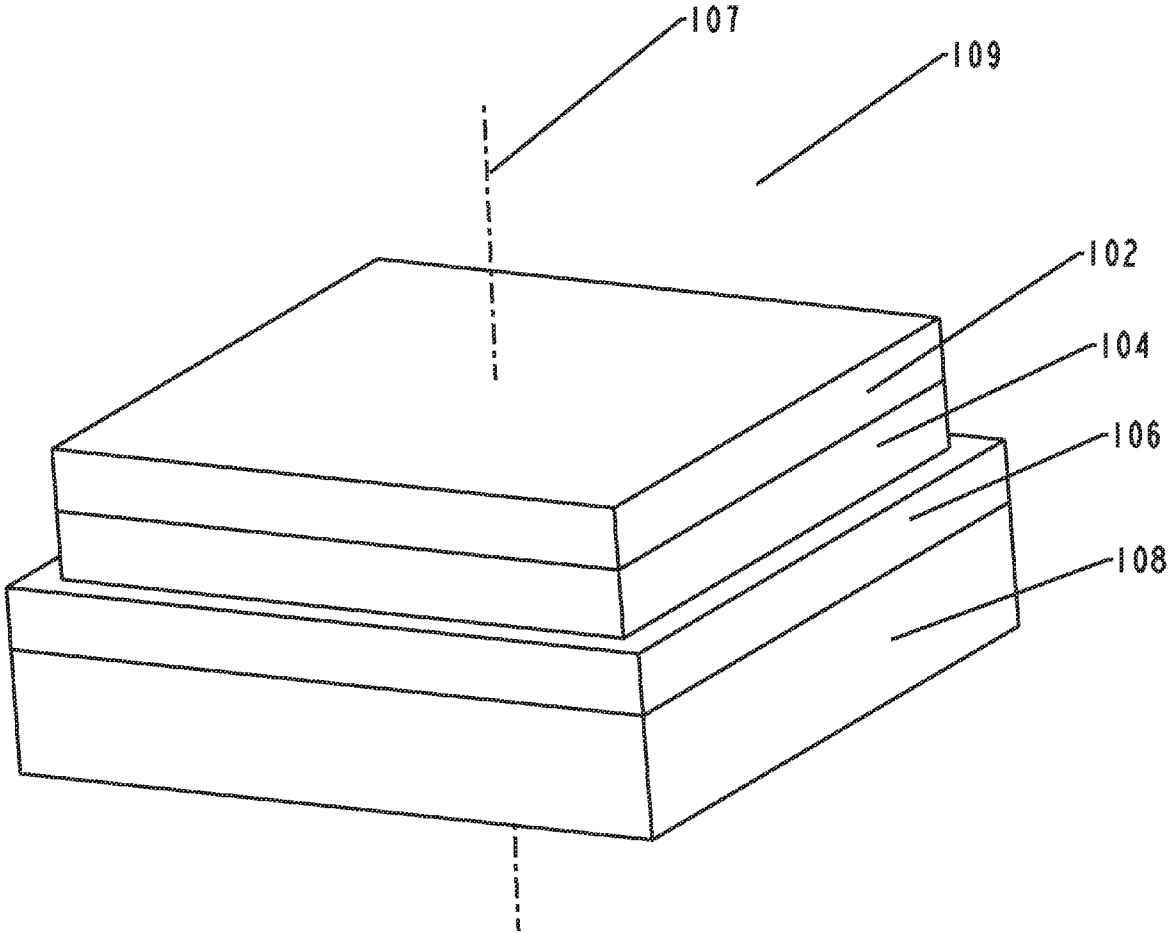
FIG. 6 comprises a perspective view of the MEMS microphone of FIGS. 1-5 according to various embodiments of the present invention.
Figure 8:
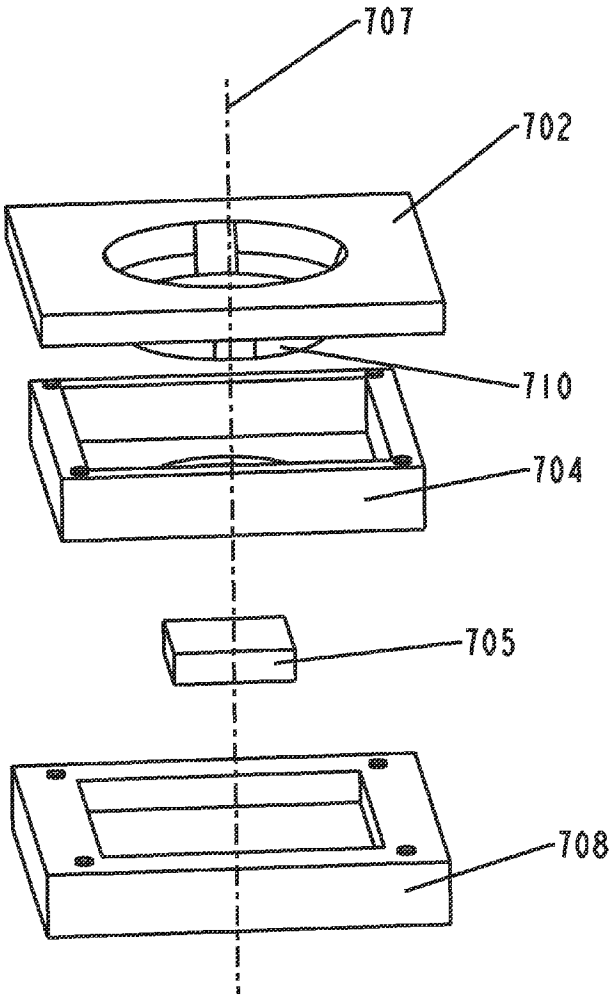
FIGS. 7 and 8 comprise perspective views of another MEMS microphone with a top port configuration and using a flip chip arrangement for both MEMS and ASIC according to various embodiments of the present invention.
Figure 7:
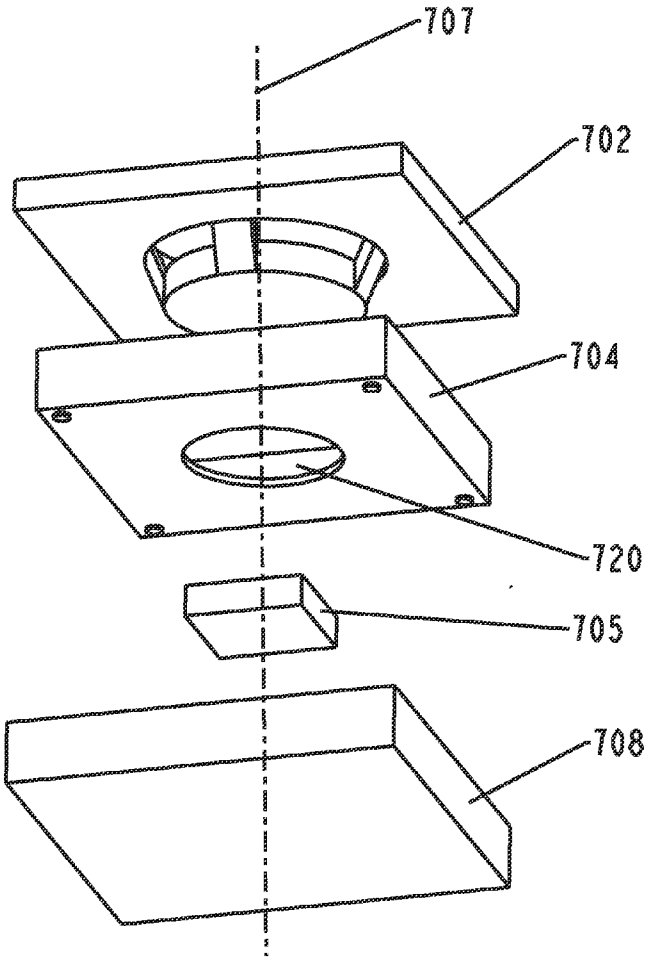
Figure 9:
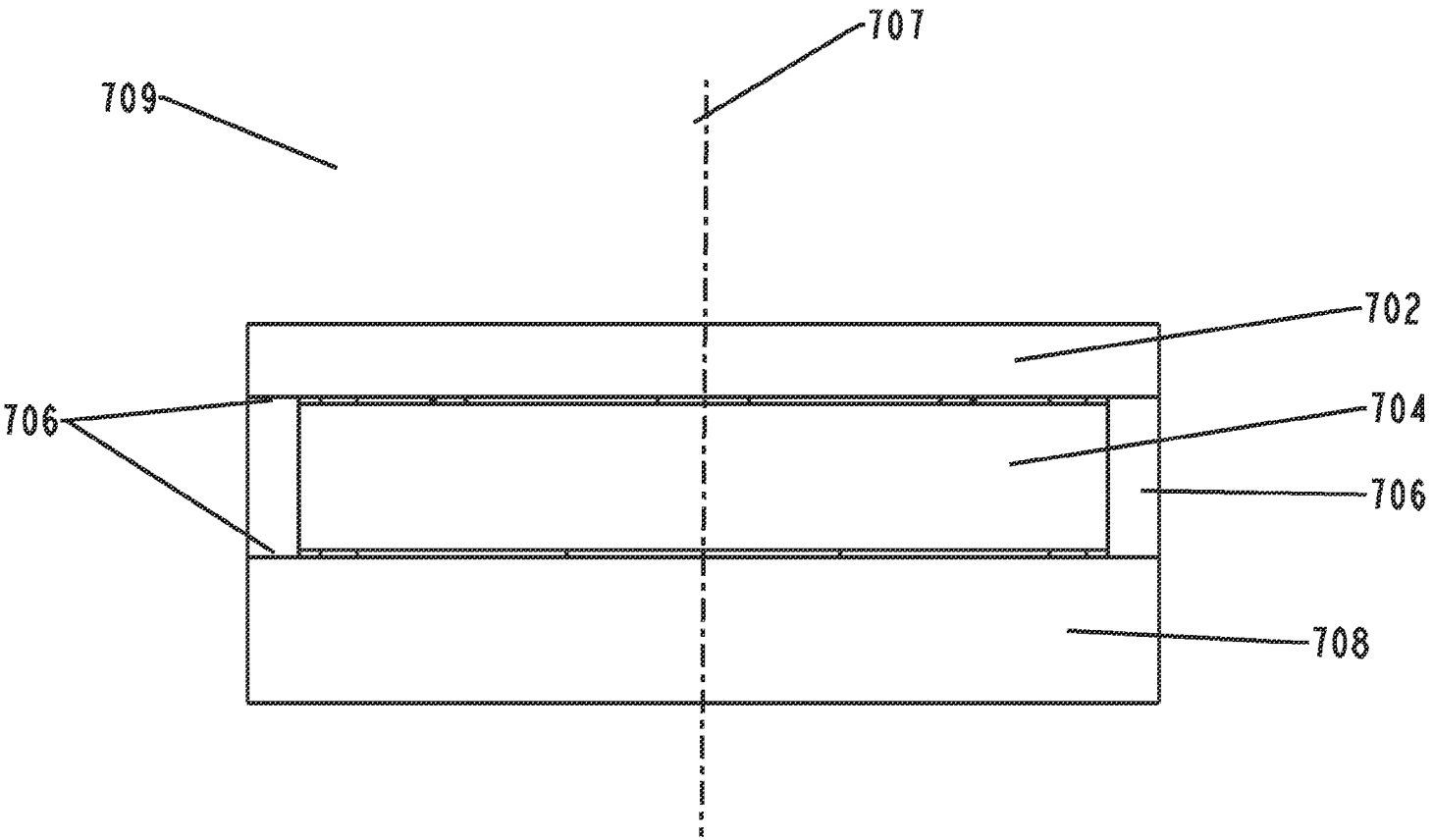
FIG. 9 comprises a partial side view of the MEMS microphone of FIGS. 7 and 8 according to various embodiments of the present invention.
Figure 10:
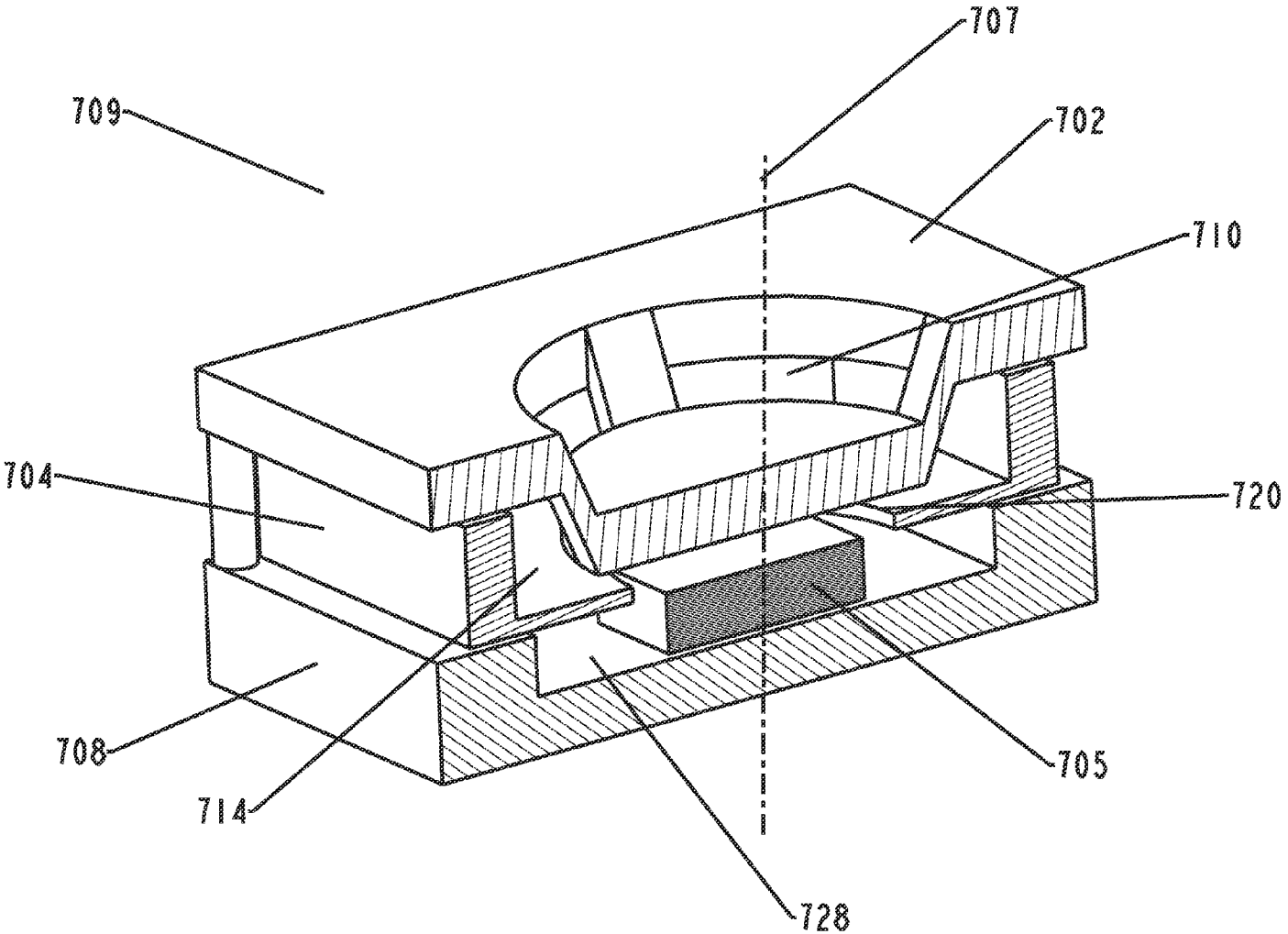
FIG. 10 comprises a mid-line cut-away perspective view of the MEMS microphone of FIGS. 7-9 according to various embodiments of the present invention.
Figure 11:
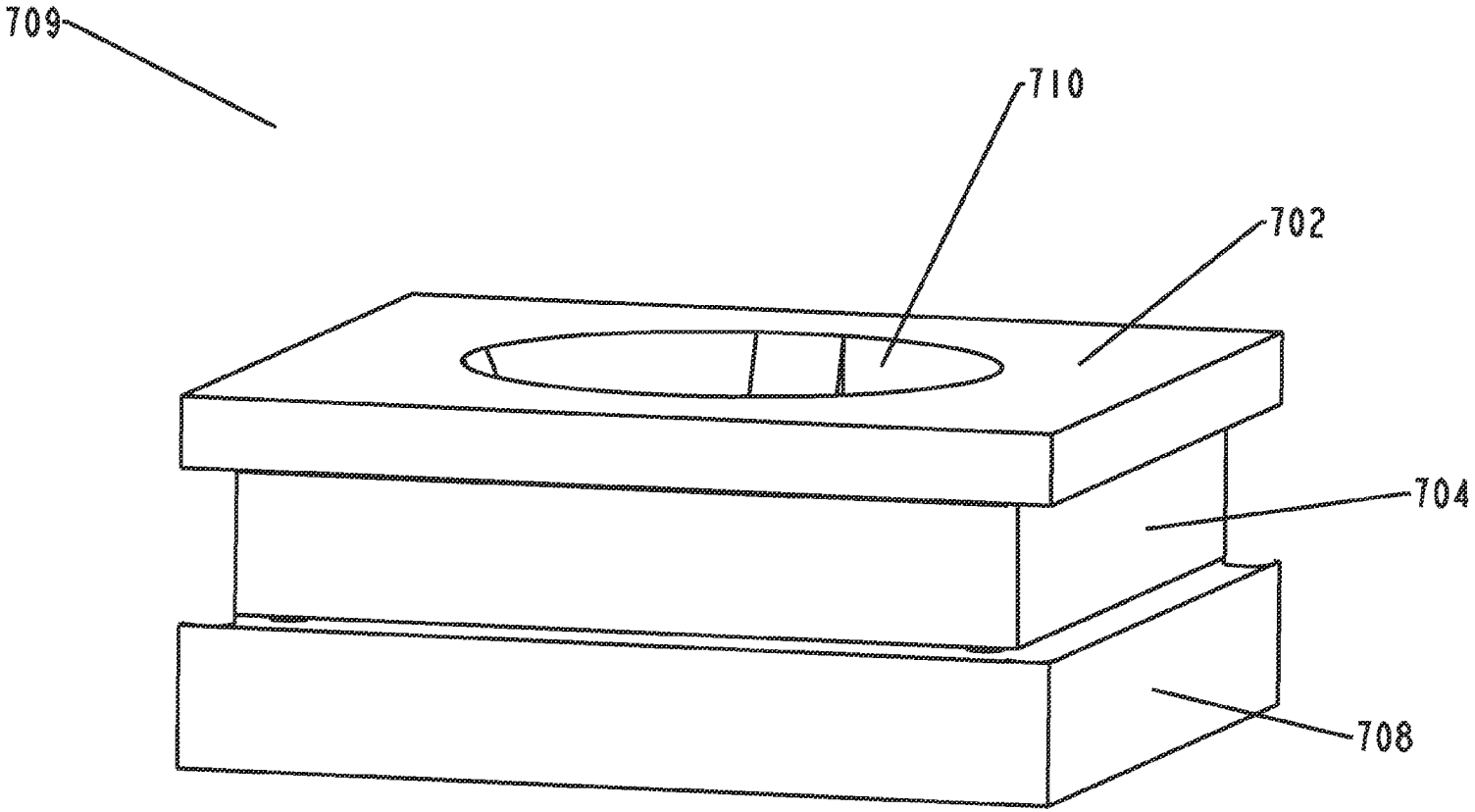
FIG. 11 comprises a perspective view of the MEMS microphone of FIGS. 7-10 according to various embodiments of the present invention.
Figure 13:
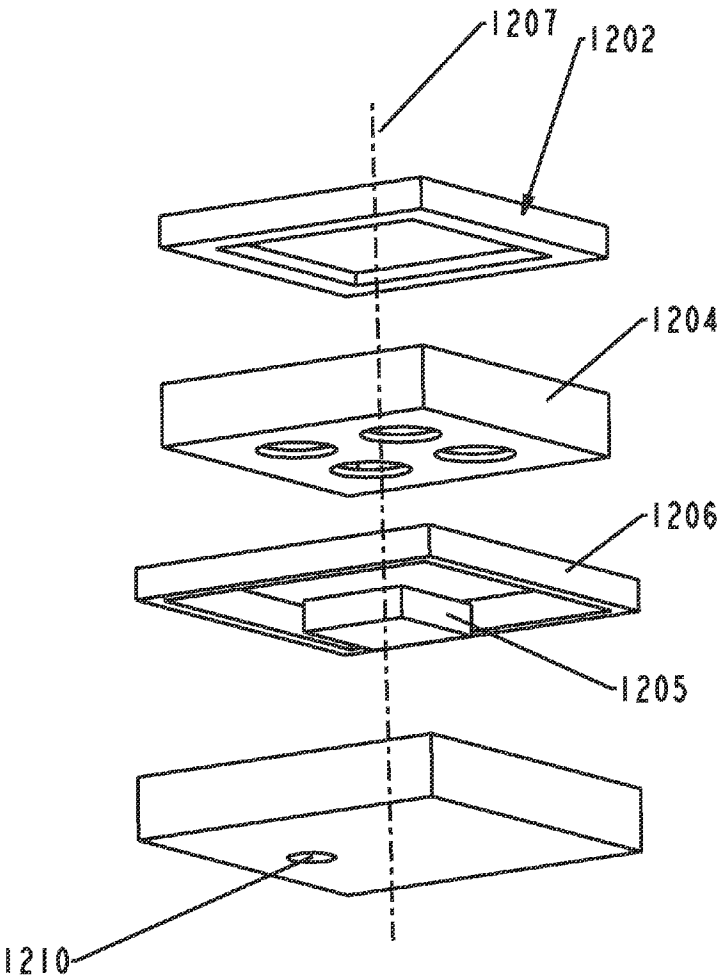
FIGS. 12 and 13 comprise perspective views of a MEMS microphone with a bottom port configuration and not using a flip chip arrangement for the MEMS with a wire bond arrangement for the ASIC according to various embodiments of the present invention.
Figure 12:
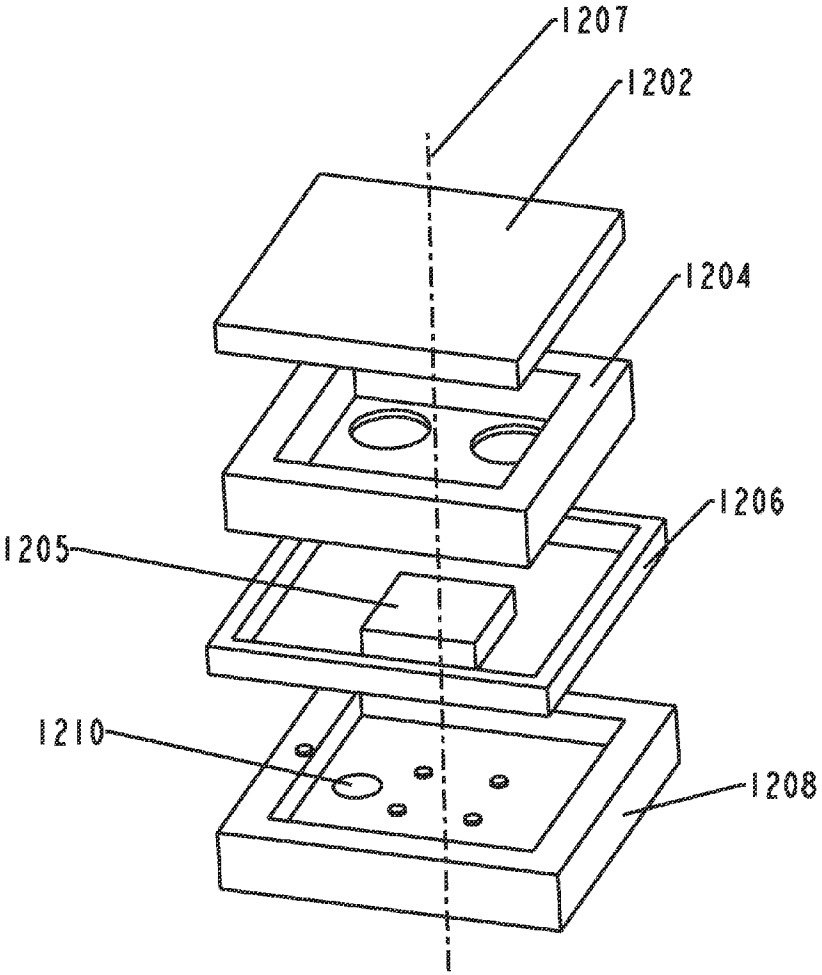
Figure 14:
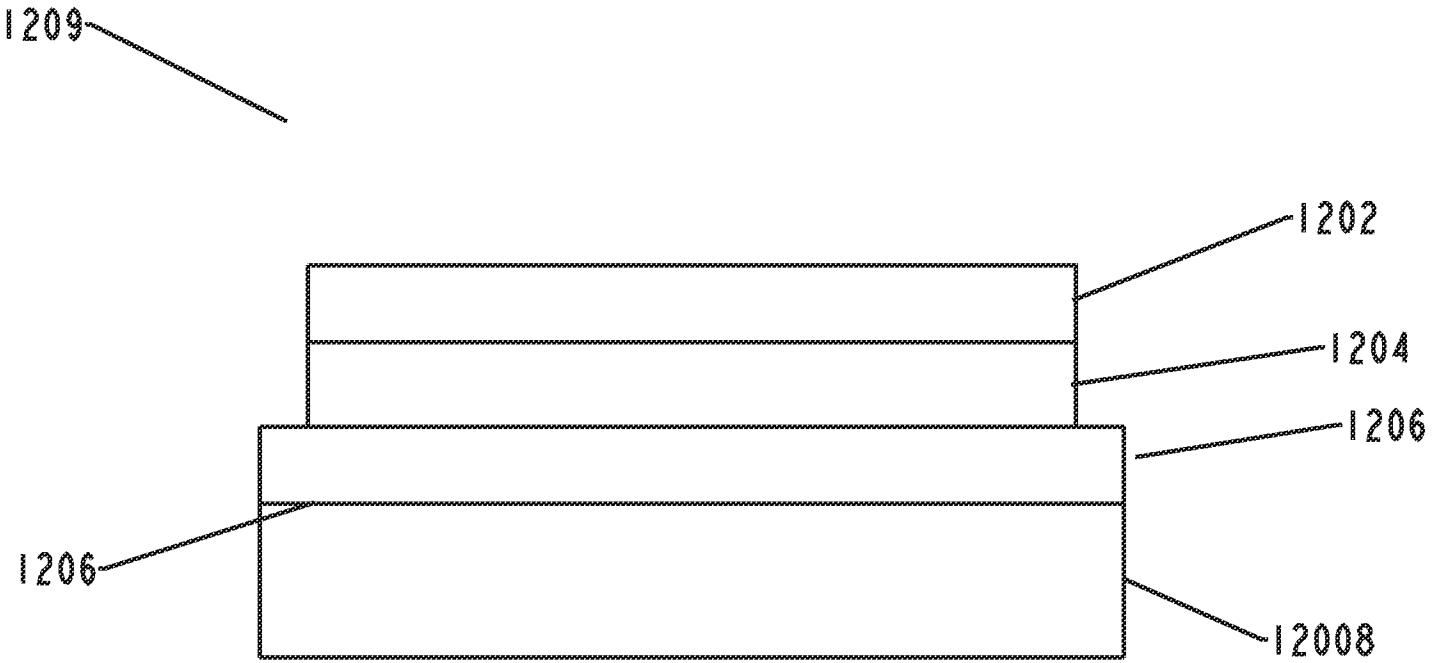
FIG. 14 comprises a side view of the MEMS microphone of FIGS. 12 and 13 according to various embodiments of the present invention.
Figure 15:
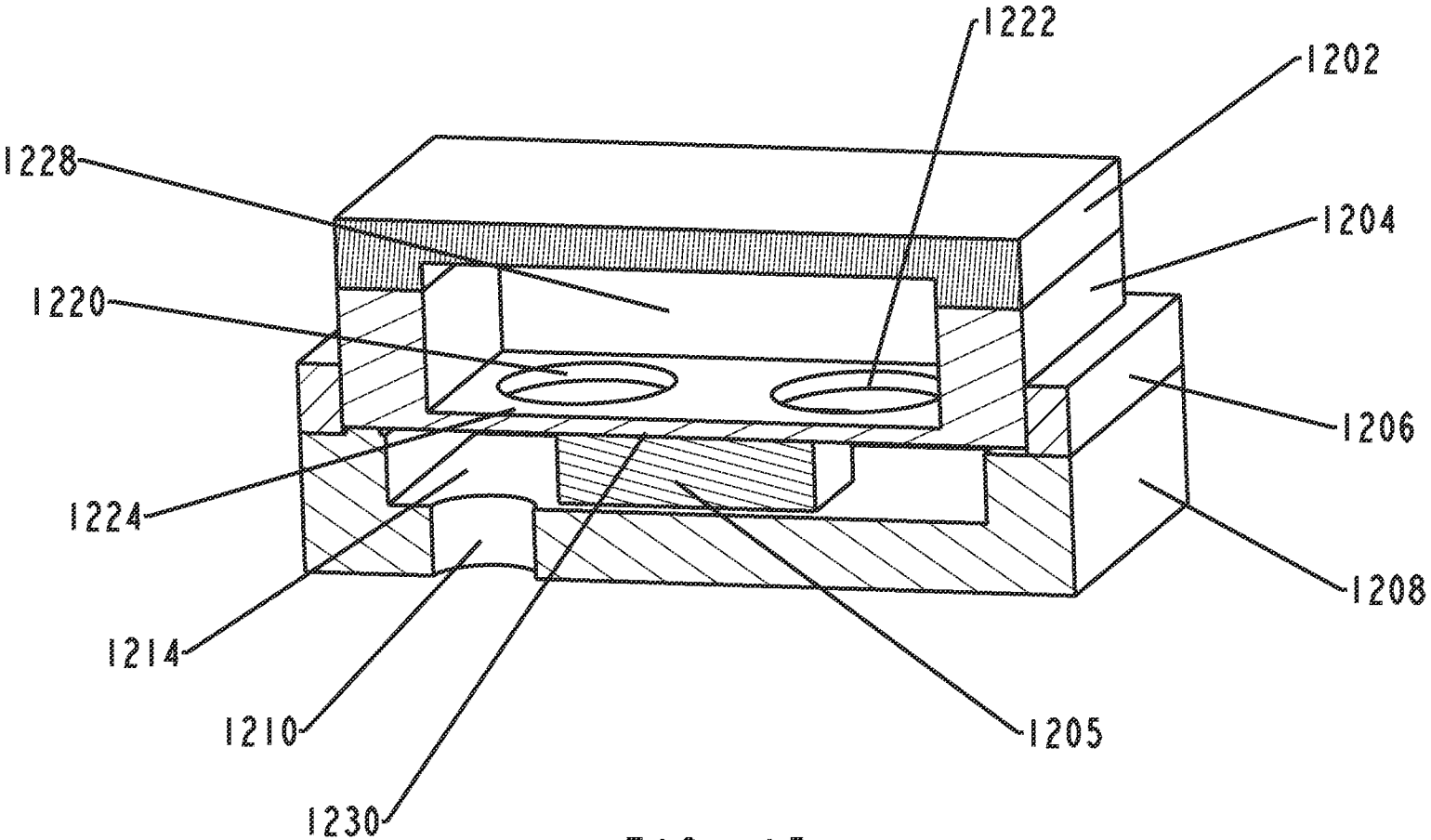
FIG. 15 comprises a mid-line cut-away perspective view of the MEMS microphone of FIGS. 12-14 according to various embodiments of the present invention.
Figure 16:
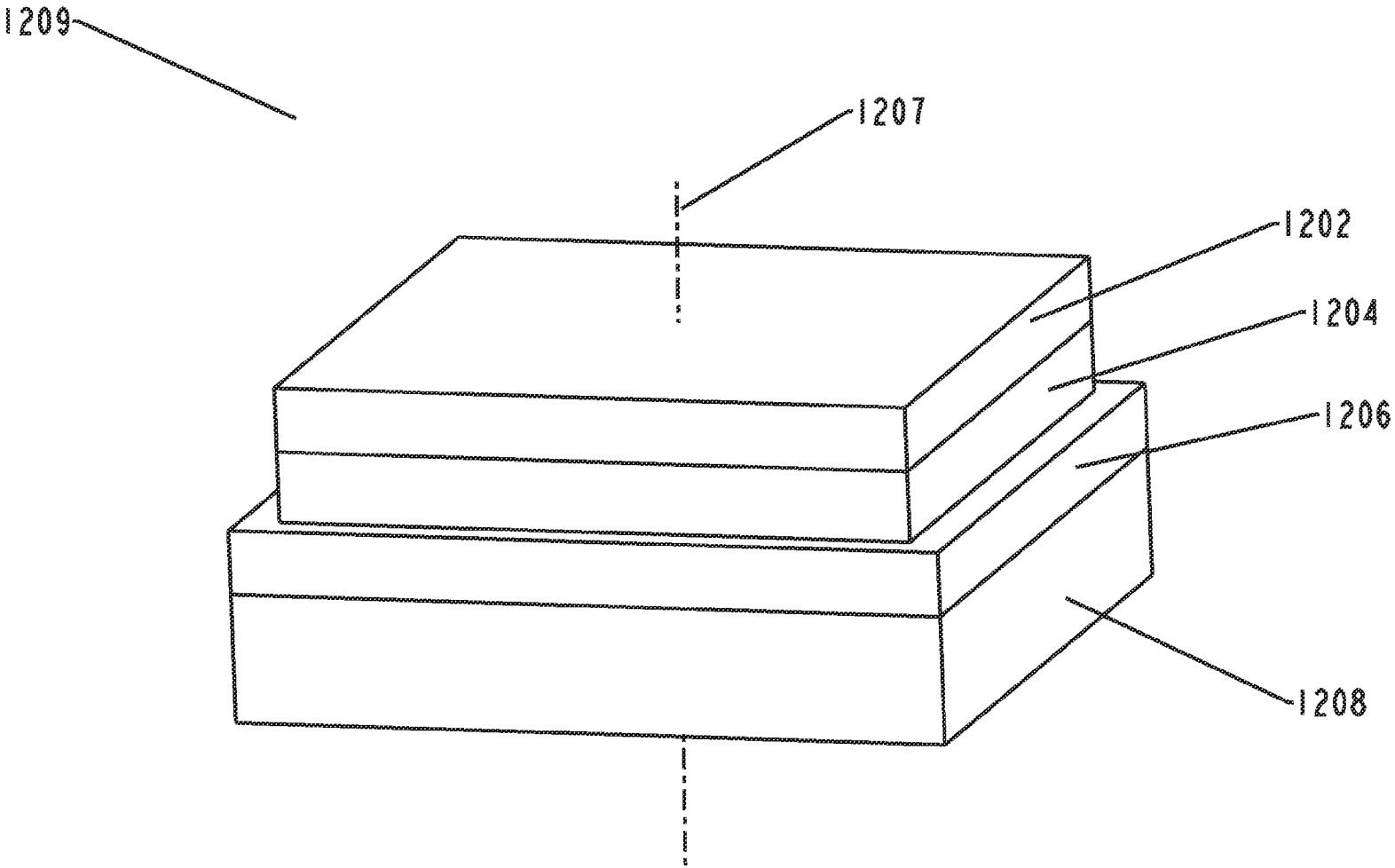
FIG. 16 comprises a perspective view of the MEMS microphone of FIGS. 12-15 according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Approaches are provided that decrease the size of MEMS microphones while maintaining the desired acoustic properties of the device. In these approaches, the MEMS die (i.e., a MEMS structure) forms part of the external microphone boundary and acts as a portion of the external assembly. In this respect, the MEMS die is not contained entirely within the housing and is not completely surrounded by the separate assembly. Instead, the MEMS die is disposed between other subcomponents. Consequently, the smallest footprint for a given MEMS assembly is provided according to the present approaches. Put another way, the size of the MEMS die defines the footprint size of the assembly (e.g., the lateral dimensions of the assembly) and the MEMS die at least in part defines a boundary to the external environment of the assembly. However, it will be appreciated that the surface of the MEMS die may not necessarily be exposed to the external environment (e.g., it may be coated with a thin film which can offer various functional performance advantages). These approaches provide a compact and highly integrated architecture as compared with previous approaches.

Another advantage of these approaches is that even though the size of the assembly is significantly reduced, an adequate volume for the back volume for the microphone is still maintained, thereby providing sufficient audio qualities for the device despite the reduced assembly size. In other words, there is no sacrifice in relative back volume size because of reduced assembly size and, hence, no sacrifice of acoustic quality of the device because the assembly size is reduced.

As used herein the term "MEMS die" refers to the MEMS structure that responds to sound pressure (e.g., including one or more diaphragms).

Referring now to FIGS. 1-6, one example of an integrated MEMS microphone 100 is described. The microphone 100 includes a lid 102, a MEMS structure 104, an integrated circuit 105, an acoustic seal 106, and a base 108 (with bottom port 110). The microphone 100 can be used in any application such as hearing aids or cellular phones to mention two examples. Other examples are of applications are possible.

The lid 102 is any type of covering structure and can be shaped and dimensioned in any number of ways. For example, it may be a flat lid with or without an inner recess (as shown in this example), a hat-shaped lid, or shaped as a can. The lid 102 may be constructed of any suitable material such as a metal, ceramic, or FR4. An acoustic seal may be provided for the lid 102 according to any known sealing technique.

The MEMS structure 104 is any suitable MEMS structure that receives sound waves and converts the sound energy (pressure) of these waves to mechanical energy using a diaphragm. More specifically, diaphragms 120 and 122 extend over openings 124 and 126. The diaphragms 120 and 122 are constructed of any suitable flexible material. The lid 102 and the MEMS structure 104 define a back volume 128 for a bottom port design. The recess in the lid 102 aids in maximizing the back volume 128 (i.e., additional volume is provided by the recess). It will be understood that the approach of FIGS. 1-6 utilizes a quad motor structure (having four diaphragms for the MEMS, each diaphragm/back plate portion being a motor), but that other configurations and numbers of motors are possible. The back volume 128 is configured to have a static pressure and, consequently, is sealed from the external environment except through the MEMS transducer (external to the assembly 100 and labeled with numerical label 109). Also, the seal 106 is provided to seal the microphone 100 (including the back volume 128) from the external environment. A mechanical attachment between the MEMS structure 104 the base 108 is generally inadequate for sealing the microphone 100.

As shown, the MEMS structure 104 contributes to the vertical dimensions of the microphone 100 along the axis labeled 107. The surfaces are not necessarily directly exposed to the external environment. In this respect, it may be coated with a thin film to provide sealing functionality, electrical insulation, and/or environmental protection.

The integrated circuit 105 (e.g., an ASIC) may perform several functions. It may supply a voltage to the MEMS structure 104 that is part of a capacitive arrangement of the structure 104 whereby the voltage of this capacitive arrangement changes as the diaphragm 120 and/or 122 moves due to changes in sound pressure. The changing sound pressure moves the diaphragm, which produces a changing voltage, and the produced voltage is fed back to the integrated circuit 105 to be processed (e.g., amplified). After the integrated circuit 105 processes the voltage, this modified voltage then can be sent from the assembly 100 to other devices for further processing (e.g., to a codec or to other circuitry in a device). It will be appreciated that the types of functions provided by the integrated circuit may be varied. For instance, the integrated circuit 105 may be an analog or digital circuit.

The acoustic seal 106 seals the MEMS 104/base 108 interface. This seal extends around the periphery of the microphone 100. It may be constructed of any suitable polymer or solder. Other example materials are possible. The acoustic seal 106 completely seals the MEMS die/base interface from external sounds.

The substrate or base 108 is constructed of a ceramic, BT, or FR4. For a bottom port design, the base 108 defines a front volume 114, in relation with the bottom port 110. The base 108 includes electrical contact pads 130, 132, 134, 136, 138, and 140. The pads 130 and 132 couple to the MEMS structure 104. The pads 134, 136, 138, and 140 couple to the integrated circuit 105. It will be appreciated that the configuration shown in FIGS. 1-6 is one particular flip chip configuration and that other pads associated with electrical connections may not be shown. It will further be appreciated that additional pads that provide mechanical connections between components can also be used but are not shown here for the sake of simplicity.

In one example of the operation of the system described in FIGS. 1-6, sound energy enters the microphone 100 via the port 110 and thereby enters the front volume 114. Diaphragms 120 and 122 and others are moved by the sound pressure. A voltage is produced between the diaphragm and a back plate (not shown) in the capacitive arrangement of the structure 104.

In this respect, a voltage may be created by the integrated circuit 105 that is supplied to the back plate. More specifically, this voltage is transmitted from the integrated circuit 105 by to pad 134, through conductive path 131, to pad 130, and then to the MEMS structure 104. The voltage (of the capacitive structure of MEMS structure 104) changes in response to pressure changes and this changing voltage is transmitted to pad 132, through a conductive path 133, to pad 138, and then to integrated circuit 105 where the voltage can be further processed. This processed voltage can then be fed to other circuitry (e.g., speakers) via another connection (e.g., that is coupled to pads 136 or 140). This other connection extends from pads 136 or 140 through the assembly 100 to the other system or device (not shown). At the other system or device, the voltage can, for example, be reconverted to sound for presentation to a user. Additionally and in another example, the voltage can be still further processed such as by various applications disposed at a cellular phone. Other examples of external devices/applications are possible.

Consequently, smaller MEMS assemblies are provided. In one example, a size of approximately 1.5 mm by approximately 1.5 mm is achieved for the top lid 102 lateral dimensions and approximately 1.76 mm by approximately 1.76 mm is provided for the base 108. The microphone 100 is approximately 0.8 mm tall overall, with the MEMS structure being approximately 0.4 mm tall in one example. This compares with previous assemblies of approximately 3.0 by approximately 1.9 mm for the lid, approximately 3.35 mm by approximately 2.5 mm for the base, and approximately 1 mm tall overall. Other examples of dimensions are possible.

Referring now to FIGS. 7-11, another example of an integrated MEMS microphone 700 is described. In contrast to the example of FIGS. 1-6, this example uses a top port 710 and not a bottom port. The assembly 700 includes a lid 702, a MEMS structure 704 with only a single motor (as compared to the quad motor example 104), an integrated circuit 705, an acoustic seal 706, and a base 708. The microphone 700 can be used in any application such as hearing aids or cellular phones to mention two examples. Other examples are of applications are possible.

The lid 702 is any type of covering structure and can be shaped and dimensioned in any number of ways. For example, it may be a flat lid with or without an inner recess, a hat-shaped lid, or shaped as a can. In this example, the lid 702 includes a punch port 710 that covers the diaphragm 720. Other configurations are possible. The lid 702 may be constructed of any suitable material such as metal, ceramic, or FR4. An acoustic seal may be provided for the lid 702 by a sealing approach such as adhesives or solder.

The MEMS structure 704 is any suitable MEMS structure that receives sound waves and converts the sound energy (pressure) of these waves to mechanical energy using a diaphragm. More specifically, diaphragm 720 is covered by the punch port 710. The diaphragm 720 is constructed of any suitable flexible material. The lid 702 and the MEMS structure 704 define a front volume 714. The port 710 communicates with the front volume 714.

As shown, the MEMS structure 704 contributes to the vertical dimensions of the microphone 700 (along the axis labeled 707). The MEMS structure is not necessarily exposed to the external environment. In this respect, it may be coated with a thin film.

The integrated circuit 705 may perform several functions. It may supply a voltage to the MEMS structure 704 that is part of a capacitive arrangement whereby the voltage of this capacitive arrangement changes as the diaphragm moves due to changes in sound pressure. The changing sound pressure moves the diaphragm which produces a voltage and this voltage is fed back to the integrated circuit to be processed (e.g., amplified). After the integrated circuit 705 processes the voltage, this modified voltage then can be sent from the microphone 700 to other devices for further processing (e.g., to a speaker or to other circuitry in a cellular phone). It will be appreciated that the types of functions provided by the integrated circuit may be varied.

The acoustic seal 706 seals the MEMS structure 704/base 708 interface. This seal extends around the periphery of the microphone 700. It may be constructed of any suitable polymer.

The substrate or base 708 is constructed of ceramic or FR4. The base 708 defines a back volume 728. The back volume 728 is configured to have a static pressure and, consequently, is completely sealed or substantially completely sealed from the external environment except through the MEMS transducer (the environment external to the assembly 700 and labeled 709). In this respect, the seal 706 is provided to seal the back volume 728 from the external environment 709. A mechanical seal between the MEMS structure 704 the base 708 is generally inadequate for sealing the back volume 728. The walls of the base 708 may be configured with sufficient height to provide an adequate back volume. The MEMS structure may be approximately 250 μm tall (along axis 707) in one example, or any other suitable height. The overall height of the assembly 700 may be approximately 0.8 mm. Other examples of dimensions are possible.

The operation of the components of the approach of FIGS. 7-11 is similar to the operation of the components of the system of FIGS. 1-6 (with the exception that sound pressure enters through the top port 710) and this operation will not be further described here.

Referring now to FIGS. 12-16, another example of an integrated MEMS microphone is described. This example assembly is similar to the example of FIGS. 1-6 except that a flip chip configuration is used for the MEMS and a wire bond configuration is used for the integrated circuit. The wire bond wires are used to transmit signals between an integrated circuit and the associated contacts for the MEMS structure and/or external devices, contained in the base.

The assembly 1200 includes a lid 1202, a MEMS structure 1204, an integrated circuit 1205, an acoustic seal 1206, and a base 1208 (with bottom port 1210). The assembly can be used in any application such as hearing aids, computers, microphones, headsets, or cellular phones to mention two examples. Other examples are of applications are possible.

The lid 1202 is any type of covering structure and be shaped and dimensioned in any number of ways. For example, it may be a flat lid with (or alternatively without) an inner recess (as shown in this example), a hat-shaped lid, or shaped as a can. Other configurations are possible. The lid 1202 may be constructed of any suitable material such as metal, ceramic, or FR4. An acoustic seal may be provided for the lid 1202 with a standard lid seal as known to those skilled in the art.

The MEMS structure 1204 is any suitable MEMS structure that receives sound waves and converts the sound energy (pressure) of these waves to mechanical energy using a diaphragm. More specifically, diaphragms 1220 and 1222 and others extend over openings 1224 and 1226. The diaphragms 1220 and 1222 are constructed of any suitable flexible material. The lid 1202 and the MEMS structure 1204 define a back volume 1228. A recess in the lid 1202 may aid in maximizing the back volume 1228 (i.e., additional volume is provided by the recess as compared to the no-recess example). It will be understand that the approach of FIGS. 12-16 utilizes a quad motor (having four diaphragms), but that other configurations are possible. The back volume 1228 is configured to have a static pressure and, consequently, is sealed from the external environment except through the MEMS transducer (external to the assembly 1200 and labeled 1209). The seal 1206 is provided to completely or substantially completely seal the microphone 1200 (including the back volume 1228) from the external environment. A mechanical seal between the MEMS structure 1204 the base 1208 is generally inadequate for sealing the microphone 1200.

As shown, the MEMS structure 1204 contributes to the vertical dimensions of the assembly 1200 indicated by the axis labeled 1207. It is not necessarily exposed to the external environment. In this respect, it may be coated with a thin film.

The integrated circuit 1205 may perform several functions. It may supply a voltage to the MEMS structure 1204 that is part of a capacitive arrangement whereby the voltage of this capacitive arrangement changes as the diaphragm moves due to changes in sound pressure. The changing sound pressure moves the diaphragm which produces a voltage and this voltage is fed back to the integrated circuit 1205 to be processed (e.g., amplified). After the integrated circuit 1205 processes the voltage, this modified voltage then can be sent from the assembly 1200 to other devices for further processing (e.g., to a speaker or to other circuitry in a cellular phone). It will be appreciated that the types of functions provided by the integrated circuit may be varied.

The acoustic seal 1206 seals the MEMS 1204/base 1208 interface. This seal extends around the periphery of the assembly 1200. It may be constructed of any suitable polymer.

The substrate or base 1208 is constructed of ceramic, BT, or FR4. The base 1208 defines a front volume 1214 which communicates with the bottom port 1210. Wires 1230 provide communications or signal paths between the integrated circuit 1205 and the MEMS structure contacts (e.g., voltage from the integrated circuit 1205 to the structure 1204). Wires 1232 provide communications or signal paths between the integrated circuit 1205 and devices external to the housing 1200 (e.g., signals to be sent to external processing circuits).

The operation of the assembly 1200 is similar to the operation of the assembly 100 (with the exception of the paths used to transmit communications between the integrated circuit and the MEMS structures and/or external devices) and this operation will not be repeated here.

Figure 17:
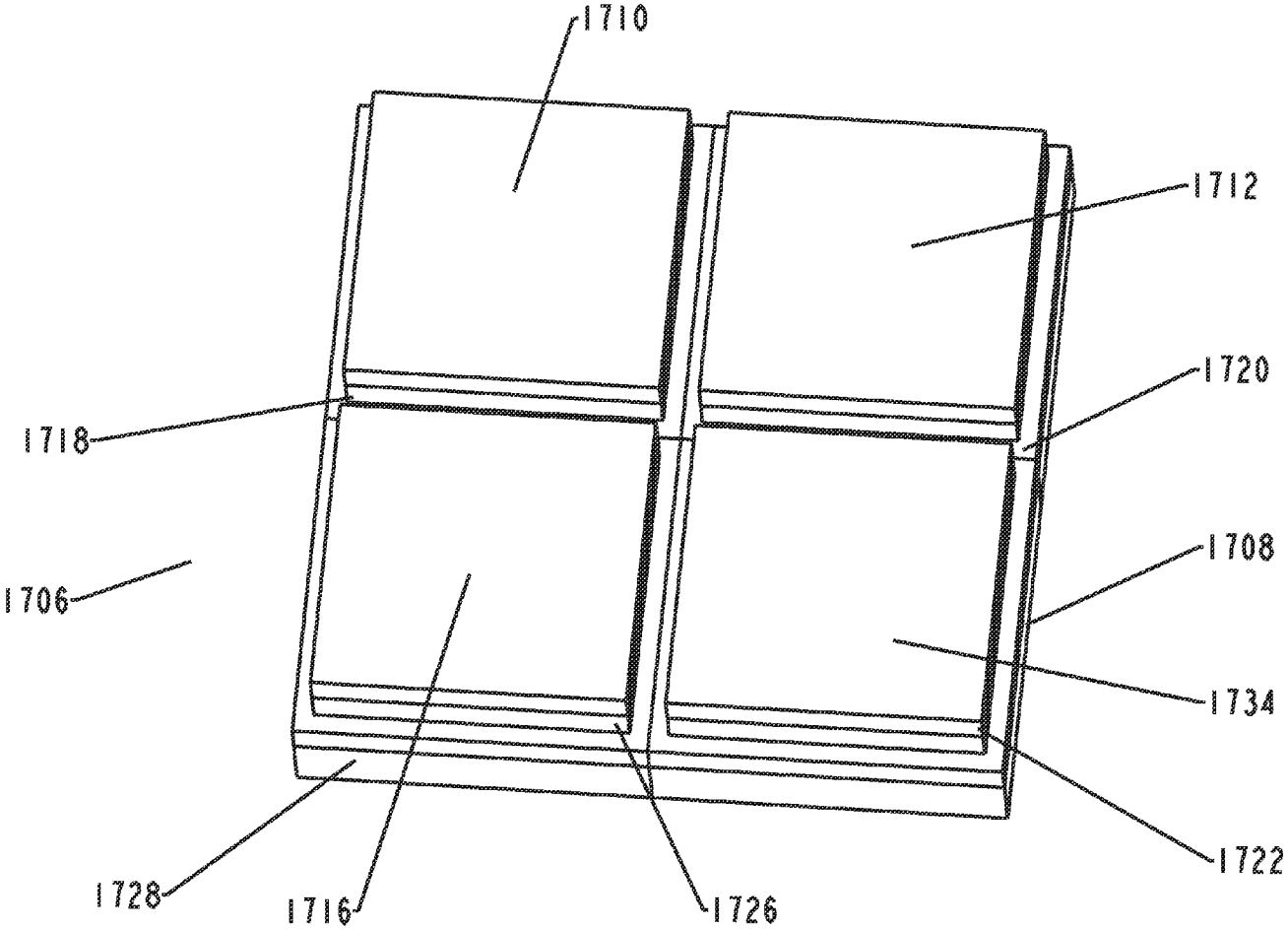
FIG. 17 comprises a perspective view of an array of assemblies before dicing and singulation according to various embodiments of the present invention.

Referring now to FIG. 17, an example of an array 1700 of devices is described as well as a method of manufacturing these devices. The array 1700 of microphones includes individual devices 1702, 1704, 1706, and 1708. Each of these individual devices includes a lid (1710, 1712, 1714, and 1716), a MEMS structure (1718, 1720, 1722, and 1724), a seal 1726, and a substrate 1728. Although only four individual devices are shown, it will be appreciated that any number of assemblies can be formed in the array 1700. As shown, the devices 1702, 1704, 1706, and 1708 are formed together on the single substrate 1728 and are later singulated or diced from the others. In one example, the devices 1710, 1712, 1714, and 1716 are the same as the assembly 100 (or the same as the assemblies 700 or 1200) as described elsewhere herein.

During manufacturing, a base substrate 1728 is formed. The integrated circuits and the MEMS structures are attached to the base substrate for each of the assemblies 1702, 1704, 1706, and 1708. The lids are then attached to each of the MEMS. As this process is performed, channels are formed and defined between the lid/MEMS die structure on top of the base substrate. Into this channel a seal (e.g., constructed of an epoxy or mold compound) can be poured, injected, or dispensed. After this seal is cured, singulation can be performed that separates the assemblies 1702, 1704, 1706, and 1708 from the others. The seal may be dispensed with a needle dispenser or any other means.

Preferred embodiments of this invention are described herein, including the best mode known to the inventors for carrying out the invention. It should be understood that the illustrated embodiments are exemplary only, and should not be taken as limiting the scope of the invention.

What is claimed:

1. A microelectomechanical (MEMS) microphone assembly, the assembly comprising: a MEMS structure, the MEMS structure including a diaphragm that responds to changes in sound pressure, the MEMS structure contributing to a vertical dimension of the assembly; a base portion, the MEMS structure being supported by the base portion; and a lid, the lid covering the MEMS structure, such that a portion of the MEMS structure at least in part defines a boundary to the external environment of the assembly, the portion extending through a side wall of the assembly.

2. The assembly of claim 1 wherein a port is disposed through the lid.

3. The assembly of claim 1 wherein a port is disposed through the base portion.

4. The assembly of claim 1 further comprising an integrated circuit coupled to the MEMS structure.

5. The assembly of claim 4 wherein the integrated circuit is mounted in a flip-chip type configuration.

6. The assembly of claim 1 wherein the portion of the MEMS structure exposed to the external environment is covered with a thin film.

7. A micromechanical (MEMS) microphone assembly, the assembly comprising:

a base comprising a plurality of terminal pads disposed on a bottom surface;

a MEMS structure comprising, at least one diaphragm responsive to acoustic pressure, and a sidewall portion of a predetermined height that completely encircles the at least one diaphragm, wherein a periphery of the bottom surface of the MEMS structure is coupled to a top surface of the base, the bottom surface of the MEMS structure and the base cooperating to form a first volume, and wherein a region of the sidewall portion is exposed to the external environment; and a lid coupled to the MEMS structure, wherein a bottom surface of the lid cooperates with a top surface of the sidewall portion of the MEMS structure to form a second volume.

8. The assembly of claim 7, wherein the region of the sidewall portion of the MEMS structure that is exposed to the external environment has a thin film formed thereon.

9. The assembly of claim 7, wherein the base further comprises a cavity, wherein the cavity and the MEMS structure cooperate to form the first volume.

10. The assembly of claim 9, further comprising an integrated circuit disposed in the cavity and electrically coupled to the at least one diaphragm disposed in the MEMS structure and the plurality of terminal pads via conductive paths in the base.

11. The assembly of claim 7, wherein the lid comprises a recessed portion, wherein the recessed portion faces the second volume when the lid is coupled to the MEMS structure.

12. The assembly of claim 7, wherein a first sealing material seals the interface between the base and the MEMS structure.

13. The assembly of claim 12, wherein a second sealing material seals the interface between the MEMS structure and the lid.

14. The assembly of claim 7, wherein the base comprises an acoustic port to allow acoustic pressure to reach the first volume.

15. The assembly of claim 14, wherein the acoustic port is disposed in a location within the cavity that is offset from the mounting location of the integrated circuit.

16. The assembly of claim 7, wherein the lid comprises an acoustic port to allow acoustic pressure to reach the second volume.

17. The assembly of claim 16, wherein the lid further comprises a member that is offset from the acoustic port to allow acoustic energy to enter the front volume.

18. The assembly of claim 17, wherein the member is positioned within the front volume to be above at least one diaphragm.

19. The assembly of claim 7, wherein the lateral dimensions of the lid and MEMS structure are substantially equal, and wherein the lateral dimensions of the base are larger than the lateral dimensions of the MEMS structure.

20. The assembly of claim 7, wherein the lateral dimensions of the lid and base are substantially equal, and wherein the lateral dimensions of the base are larger than the lateral dimensions of the MEMS structure.

* * * * *